US005195499A

United States Patent [19]

Thorne

[11] Patent Number: 5,195,499

[45] Date of Patent: Mar. 23, 1993

[54] APPARATUS FOR ROTATABLY LAUNCHING SAUCER-SHAPED GAME DISC

[76] Inventor: John S. Thorne, 21941 Ybarra Rd., Woodland Hills, Calif. 91364-4237

[21] Appl. No.: 825,474

[22] Filed: Jan. 24, 1992

[51] Int. Cl.[5] ..... F41J 9/18

[52] U.S. Cl. ..... 124/1; 124/42; 124/81

[58] Field of Search ..... 124/1, 4, 5, 6, 41.1, 124/42, 78, 79, 81; 273/129 R, 340

[56] References Cited

U.S. PATENT DOCUMENTS 1,138,401 5/1915 Olmstead ..... 124/79 X
2,886,320 5/1959 Van Hennik ..... 124/5 X
3,959,915 6/1976 Kettlestrings ..... 124/42 X
4,030,472 6/1977 Watkins ..... 124/42 X
4,165,580 8/1979 Miura ..... 124/5 X
4,508,093 4/1985 Bertini ..... 124/81 X

*Primary Examiner*—Randolph A. Reese
*Assistant Examiner*—John A. Ricci
*Attorney, Agent, or Firm*—John J. Posta, Jr.

[57] ABSTRACT

A device for launching a plastic, saucer-shaped game disc is disclosed which spins such a saucer-shaped game disc up to a high rotational rate, and then discharges the rotating saucer-shaped game disc from the apparatus in a generally upward direction. The device uses a drive wheel and a spring-biased idler wheel to retain the inner rim of a saucer-shaped game disc thereon, whereby the saucer-shaped game disc may be accelerated to a desired rotational speed. The device then uses a foot pedal-actuated rod bearing on the bottom of the center of the saucer-shaped game disc to propel it upwardly, from which launching the disc may be used to perform various free-style maneuvers.

22 Claims, 4 Drawing Sheets

FIG. 22
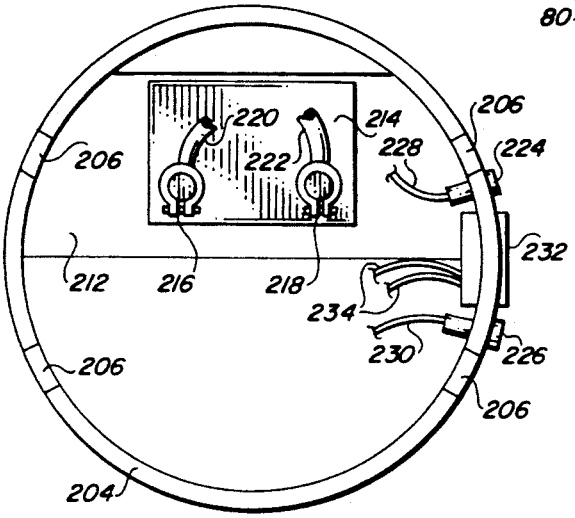
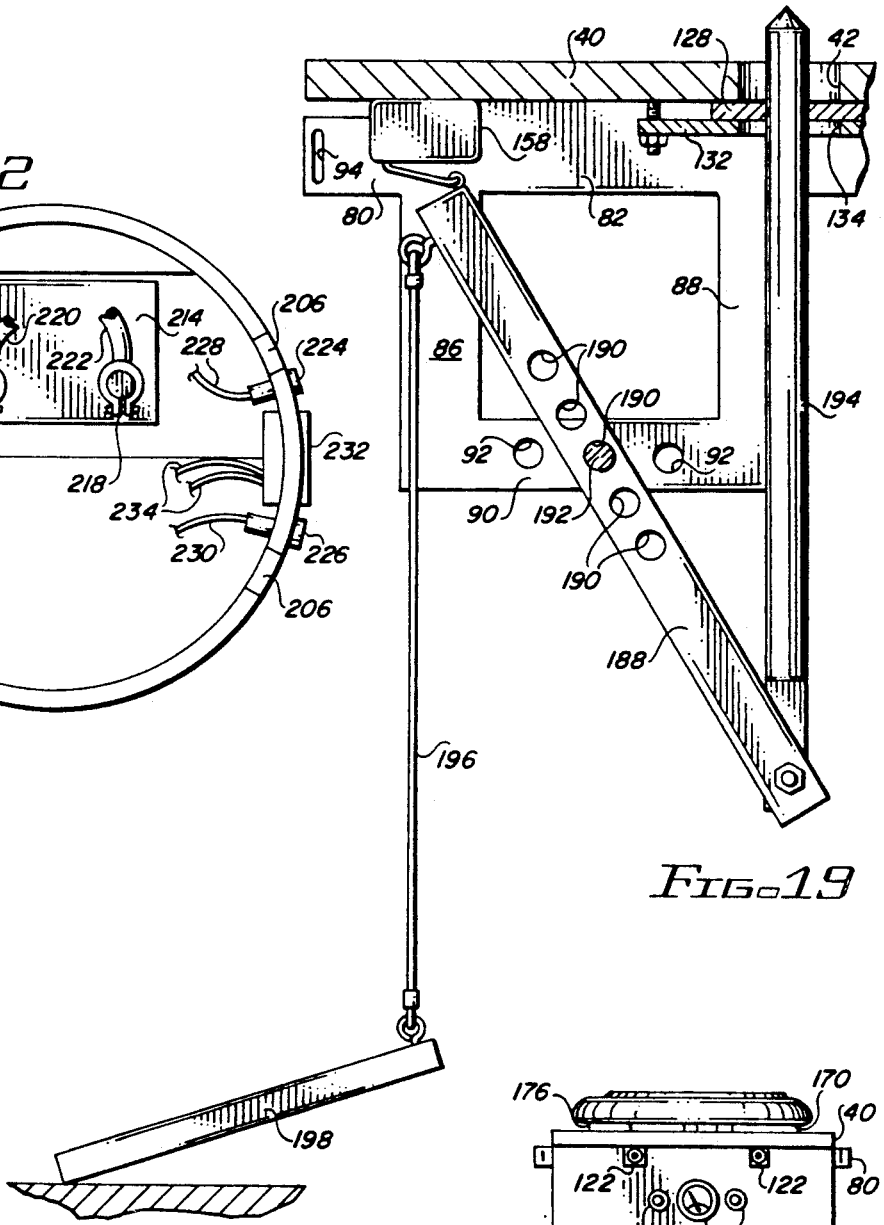
FIG. 19
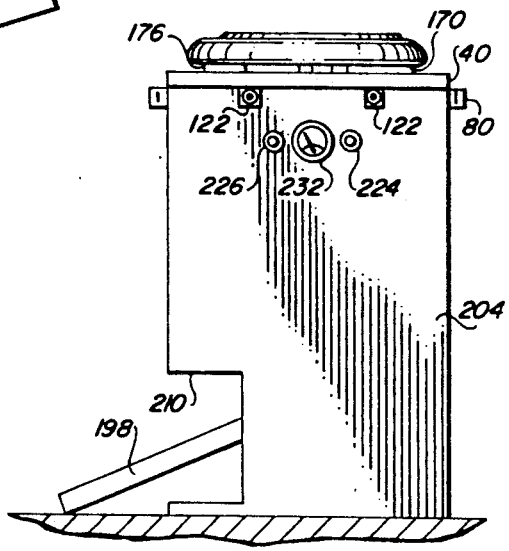
FIG. 26

APPARATUS FOR ROTATABLY LAUNCHING SAUCER-SHAPED GAME DISC

BACKGROUND OF THE INVENTION

1. Field of the Invention

The present invention relates generally to a device for launching a plastic, saucer-shaped game disc, and more particularly to an apparatus which spins such a saucer-shaped game disc up to a high rotational rate, and then allows the rotating saucer-shaped game disc to be discharged from the apparatus in a generally upwardly direction.

One of the most popular and enduring sport implements over the last several decades has been the plastic saucer-shaped game disc, known particularly as a Frisbee® (Frisbee® being a registered trademark of Wham-O Manufacturing Company). The saucer-shaped game discs, which are available in a wide variety of sizes and colors, are a particularly popular outdoor recreational implement, and may be seen at the beach and in parks, as well as on the streets and in back yards. In addition to being used for a catching game, the saucer-shaped game disc is used in a sport referred to as disc free-styling, in which various tricks are done with the saucer-shaped game discs. For example, the saucer-shaped game discs may be spun and then balanced on a finger while the saucer-shaped game disc is still spinning.

One of the essential preambles to doing such free-style activities is thus the initial spinning of the saucer-shaped game disc, preferably at as high a rotational rate as is possible. It will be recognized particularly by those skilled in the art of saucer-shaped game disc free-styling that it is difficult to get a saucer-shaped game disc to spin at a high rate without throwing it. Thus, commonly one person will throw the saucer-shaped game disc to start it spinning, while another person will catch the spinning saucer-shaped game disc on a finger. Free-styling tricks involving a spinning saucer-shaped game disc thus become more difficult when only one person is playing.

It is accordingly the primary objective of the present invention that it provide a disc launching apparatus for spinning and launching saucer-shaped game discs. A further objective of the present invention is that the disc launching apparatus be capable of releasing a saucer-shaped game disc from the disc launching apparatus locally after spinning it at high speed, instead of throwing the saucer-shaped game disc away from the disc launching apparatus. It is thus an objective of the disc launching apparatus of the present invention that it provide sufficient directional control during the ejection of the saucer-shaped game disc to cause the saucer-shaped game disc to be repeatedly provided to the user at essentially the same location relative to the disc launching apparatus.

It is a further objective of the disc launching apparatus of the present invention that it be both compact and portable to allow it to be easily carried to any desired location. The disc launching apparatus must also be both easy and safe to use. In a further objective of the present invention, the disc launching apparatus should be automatically adjustable to fit various size saucer-shaped game discs (at least accommodating all full size discs). It is yet another objective of the disc launching apparatus of the present invention that it provide the ability to "charge" light-emitting saucer-shaped game discs prior to ejecting them from the disc launching apparatus, thereby causing the light-emitting saucer-shaped game discs to glow at night after their release.

The disc launching apparatus of the present invention must also be of construction which is both durable and long lasting, and should also require little or no maintenance to be provided by the user. In order to enhance the market appeal of the disc launching apparatus of the present invention, it should be inexpensive both to manufacture and to use. Finally, it is also an objective that all of the aforesaid advantages and objectives of the disc launching apparatus of the present invention be achieved without incurring any substantial relative disadvantage.

SUMMARY OF THE INVENTION

The disadvantages and limitations of the background art discussed above are overcome by the present invention. With this invention, a disc launching apparatus is first used to spin a saucer-shaped game disc placed on it at high speed. After the saucer-shaped game disc is spinning at high speed, it may be launched generally upwardly off of the disc launching apparatus. The disc launching apparatus is called the Disc Popper TM, which trademark is proprietary to the assignee of the present invention.

The disc launching apparatus of the present invention has a flat disc support plate mounted on top of a housing. Extending from the top of the disc support plate on one side thereof is a first drive wheel, which is fixed in location and which may be driven to rotate by an electric motor located inside the housing. Located on the top of the disc support plate on the other side thereof is a rotatable idler wheel, which is moveable toward and away from the drive wheel. The idler wheel is spring biased away from the drive wheel. Both the drive wheel and the idler wheel preferably have frictional outer wheel surfaces.

Accordingly, saucer-shaped game discs of varying sizes may be placed first over the idler wheel, and then, by moving the idler wheel toward the drive wheel, over the drive wheel. Several support bars are located on the top surface of the disc support plate to support a saucer-shaped game disc on the bottom side thereof and to keep it aligned to ensure proper contact with the outer surfaces of the drive and idler wheels. In the preferred embodiment, the drive and idler wheels may both be mounted at a slight downward angle where they contact the inner rim of the saucer-shaped game disc to retain the saucer-shaped game disc on the drive and idler wheels as the saucer-shaped game disc is rotated up to speed.

Located in the disc launching apparatus is a launching mechanism, which includes a ejection rod which extends from the top of the disc support plate at the center thereof. The ejection rod is moveable axially between a first position in which it is not quite in contact with a saucer-shaped game disc located on the disc launching apparatus, and a second position in which it protrudes further from the top of the disc support plate (with respect to the first position) to eject the saucer-shaped game disc from the disc launching apparatus. In the preferred embodiment, the ejection rod is moved from the first position to the second position by actuation of a foot pedal by the user.

The disc launching apparatus is battery powered and portable. It includes control circuitry for operating the drive wheel upon actuation of a start switch. In the preferred embodiment, the start switch is actuated by pressing down on the center of a saucer-shaped game disc located on the disc launching apparatus. A no disc switch is used to detect the presence of a saucer-shaped game disc on the disc launching apparatus; without a saucer-shaped game disc in place, the drive motor will not operate.

In the preferred embodiment, when the drive motor of the disc launching apparatus is started, it will gradually build up to maximum speed. The maximum speed allowed may optionally be variable, either between two or more discrete speeds, or in an infinitely variable manner up to a maximum speed. When the saucer-shaped game disc has reached maximum speed, it may be ejected by the user stepping on the foot pedal. The saucer-shaped game disc will be ejected essentially upwardly, although in the preferred embodiment the position of the ejection rod may be varied to provide a slight amount of direction to be imparted to the saucer-shaped game disc as it is launched.

The disc launching apparatus of the preferred embodiment also includes a switch to select either clockwise or counterclockwise rotation of the saucer-shaped game disc. An alternate method of indicating the desired direction of disc rotation would be to put the motorized drive wheel on a spring arm such as the idle wheel is now in the current embodiment and sense from which direction the user had placed the disc on the disc launching apparatus. Placing the disc first over the motorized drive wheel and pulling it toward the idle wheel before dropping it in place would define the disc to be spun in one direction. Placing the disc first over the idle wheel and pulling it toward the motorized wheel before dropping it in place would define the disc to be spun in the opposite direction. This method, although more mechanically complex, eliminates the need to reach for and exercise a switch while groups of users with differing spin direction desires operate the disc launching apparatus. In an additional aspect of the present invention, a lamp member is located on the top of the disc support plate in a position to shine on a saucer-shaped game disc located on the disc launching apparatus. The lamp member is used to "charge" a light-emitting saucer-shaped game disc located on the disc launching apparatus, prior to ejecting it from the disc launching apparatus, thereby causing the light-emitting saucer-shaped game disc to glow at night after its release. A switch is used to enable or disable the lamp members automatic operation.

It may therefore be seen that the present invention teaches a disc launching apparatus for spinning and launching saucer-shaped game discs. The disc launching apparatus of the present invention is capable of releasing a saucer-shaped game disc locally to the disc launching apparatus after spinning it at high speed, instead of throwing the saucer-shaped game disc away from the disc launching apparatus. The disc launching apparatus of the present invention also provides sufficient directional control during the ejection of the saucer-shaped game disc to cause the saucer-shaped game disc to be repeatedly provided to the user at essentially the same location relative to the disc launching apparatus.

The disc launching apparatus of the present invention is both compact and portable, thereby allowing it to be easily carried to any desired location. The disc launching apparatus is also both easy and safe to use. The disc launching apparatus is automatically adjustable to fit various size saucer-shaped game discs (accommodating all full size discs). In a further aspect of the present invention, the disc launching apparatus provides the ability to "charge" light-emitting saucer-shaped game discs prior to ejecting them from the disc launching apparatus, thereby causing the light-emitting saucer-shaped game discs to glow at night after their release.

The disc launching apparatus of the present invention is of durable and long lasting construction, and requires little or no maintenance to be provided by the user. The disc launching apparatus of the present invention is inexpensive both to manufacture and to use, thereby affording it the broadest possible market appeal. Finally, all of the aforesaid advantages and objectives of the disc launching apparatus of the present invention are achieved without incurring any substantial relative disadvantage.

DESCRIPTION OF THE DRAWINGS

These and other advantages of the present invention are best understood with reference to the drawings, in which:

FIG. 19 is a somewhat schematic side view of a disc ejection mechanism, including an ejection rod extending through sectional portions of the disc support plate illustrated in FIGS. 1 through 4, the support washer illustrated in FIG. 10, and the square support plate illustrated in FIG. 11, and also including a pivotally mounted link member mounted on a sectional portion of a pivot rod and a foot pedal connected to the link member by a cable member;

FIG. 22 is a top plan view of a housing member, showing a battery located on a shelf mounted in the housing member, and also showing a battery gauge and two charging terminals mounted in the side of the housing member;

FIG. 26 is a side view of the assembled disc launching apparatus of the present invention with a saucer-shaped game disc installed thereon for launching.

DETAILED DESCRIPTION OF THE PREFERRED EMBODIMENT

The preferred embodiment of the present invention supports a saucer-shaped game disc on top of a disc launching apparatus, where the saucer-shaped game disc is first rotated to a high speed spin, and from which the saucer-shaped game disc is then launched upwardly. The heart of the disc launching apparatus is a disc support plate 40, which is illustrated in FIGS. 1 through 4. The disc support plate 40 is of a generally flat, circular configuration, and is made in the preferred embodiment of molded plastic, although it may also be made of metal.

The disc support plate 40 has a circular aperture 42 extending through the center thereof, which circular aperture 42 is relatively considerably larger than the diameter of an ejection rod (not shown in FIGS. 1 through 4) which will extend therethrough. The purpose of the size of the circular aperture 42 will become apparent later.

Figure 1:
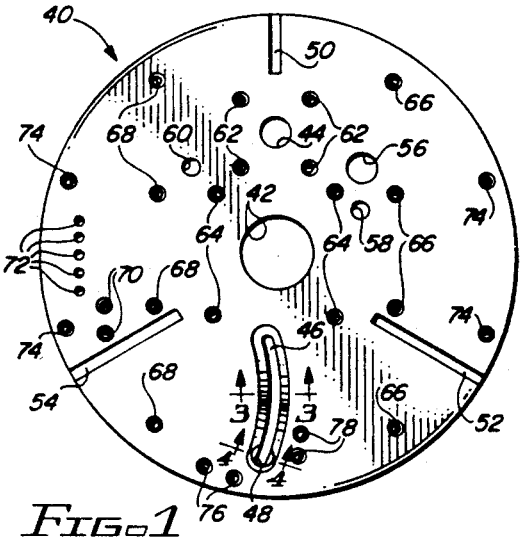
FIG. 1 is a top plan view of a disc support plate which will be located on top of the disc launching apparatus and on which saucer-shaped game discs will be rotated and from which saucer-shaped game discs will be launched, showing three support bars used to rotatably support the bottom of a saucer-shaped game disc, and also showing the top configuration of a curved slot located in the disc support plate.
Figure 2:
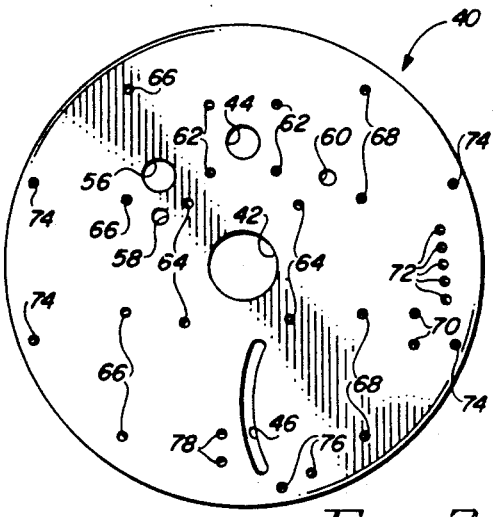
FIG. 2 is a bottom plan view of the disc support plate illustrated in FIG. 1, showing the bottom configuration of the curved slot located in the disc support plate.

Located between the circular aperture 42 and the back edge of the disc support plate 40 (the top edge as illustrated in FIGS. 1 and 2) is a circular motor shaft aperture 44, which extends through the disc support plate 40. A drive wheel (not shown in FIGS. 1 through 4) will be mounted above the disc support plate 40, and will be located concentrically with the motor shaft aperture 44.

Figure 3:
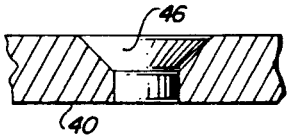
FIG. 3 is a first partial sectional view of the disc support plate illustrated in FIGS. 1 and 2, showing the configuration of the curved slot at a first location.
Figure 4:
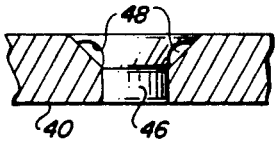
FIG. 4 is a second partial sectional view of the disc support plate illustrated in FIGS. 1 through 3, showing the configuration of the curved slot at a second location.

Located between the circular aperture 42 and the front edge of the disc support plate 40 (the bottom edge as illustrated in FIGS. 1 and 2) is a curved slot 46, the ends of which are located on a common radius of the disc support plate 40. An idler wheel (not shown in FIGS. 1 through 4) will be mounted above the disc support plate 40, and will be moveable along the curved slot 46. The curved slot 46 is Y-shaped in cross section, as best shown in FIGS. 3 and 4. The top of the Y is the top of the disc support plate 40, as shown in FIG. 1.

Located in the top portion of the Y in the curved slot 46 at or near the end of the curved slot 46 which closest to the front edge of the disc support plate 40 is an upwardly extending protrusion 48. The protrusion 48 is split by the curved slot 46, with the halves of the protrusion 48 extending above the profile of the Y-shape of the curved slot 46. The purpose of the protrusion 48 is to act as a frictional brake on the idler wheel (not shown in FIGS. 1 through 4) to stop it from spinning when it is at or near the end of the curved slot 46 which closest to the front edge of the disc support plate 40.

Referring now to FIGS. 1 and 2, located on the top side of the disc support plate 40 are three support bars 50, 52, and 54 extending above the top surface of the disc support plate 40. Alternatively, instead of the support bars 50, 52, and 54, bearings could also be used. The support bars 50, 52, and 54 are radially located with their ends at or near the outer edges of the disc support plate 40, and are spaced at approximately even angular distances. The support bar 50 is at the rear edge of the disc support plate 40 (the top edge as illustrated in FIGS. 1 and 2). The support bar 52 is located approximately 120 degrees clockwise from the support bar 50, and the support bar 54 is located approximately 120 degrees counterclockwise from the support bar 50 (and approximately 120 degrees clockwise from the support bar 52).

The support bars 52 and 54 are approximately twice as long as the support bar 50. This is necessarily so since a saucer-shaped game disc (not shown) of any size will have its bottom edge mounted in approximately the same place on the support bar 50, while the bottom edges of different size saucer-shaped game discs will be mounted in different locations on the support bars 52 and 54 according to the size of the saucer-shaped game discs. In the preferred embodiment, the support bars 52 and 54 extend approximately halfway toward the center of the disc support plate 40.

A number of other apertures are located in the disc support plate 40. The locations of these apertures may be described using directions established with respect primarily to the view of FIG. 1 (the top side of the disc support plate 40). The front and back edges (and directions) are as defined above with respect to FIG. 1 (and are also true with respect to FIG. 2). The right and left edges (and directions) shall be defined with respect to FIG. 1 only.

An aperture 56 which shall be used to receive a lamp assembly (not shown in FIGS. 1 and 2) is located in the disc support plate 40 toward the right edge and a little toward the front edge from the motor shaft aperture 44. Located in the disc support plate 40 toward the front edge from the aperture 56 is an aperture 58, which shall be used to receive a switch (not shown in FIGS. 1 and 2). Located in the disc support plate 40 toward the left edge and a little toward the front edge from the motor shaft aperture 44 is an aperture 60, which shall also be used to receive a switch (not shown in FIGS. 1 and 2).

A number of countersunk apertures are located in the disc support plate 40, with the countersunk portion of these apertures being located in the top surface of the disc support plate 40. Located around the motor shaft aperture 44 are four countersunk apertures 62, which will be used for screws used to attach a motor (not shown in FIGS. 1 and 2) to the bottom side of the disc support plate 40. Located around the circular aperture 42 are four countersunk apertures 64, which will be used for screws used to attach a square support plate (not shown in FIGS. 1 and 2) to the bottom side of the disc support plate 40.

Located between the center and the right edge of the disc support plate 40 are four countersunk apertures 66 which are evenly spaced along a line parallel to a line extending between the front and back edges of the disc support plate 40. The countersunk apertures 66 will be used for screws used to attach a first frame member (not shown in FIGS. 1 and 2) to the bottom side of the disc support plate 40. Similarly, located between the center and the left edge of the disc support plate 40 are four countersunk apertures 68 which are evenly spaced along a line parallel to the line extending between the front and back edges of the disc support plate 40. The countersunk apertures 68 will be used for screws used to attach a second frame member (not shown in FIGS. 1 and 2) to the bottom side of the disc support plate 40.

Located between the countersunk apertures 68 and the left edge of the disc support plate 40 directly to the left of the end of the curved slot 46 which closest to the center of the disc support plate 40 are two countersunk apertures 70 defining between them a line parallel to the line extending between the front and back edges of the disc support plate 40. The countersunk apertures 70 will be used for screws used to attach a support member 182 (not shown in FIGS. 1 and 2) to the bottom side of the disc support plate 40.

Located to the left of the countersunk apertures 70 are five apertures 72 evenly spaced along a line parallel to the line extending between the front and back edges of the disc support plate 40. One of the apertures 72 will be used to retain a first end of a spring (not shown in FIGS. 1 and 2).

Located along the right edge of the disc support plate 40 are two countersunk apertures 74. Similarly, located along the left edge of the disc support plate 40 are two countersunk apertures 74. The four countersunk apertures 74 will be used to attach L-shaped brackets (not shown in FIGS. 1 and 2) to the bottom side of the disc support plate 40.

Located near the front edge of the disc support plate 40 just to the left of the curved slot 46 are two countersunk apertures 76. The countersunk apertures 76 will be used to mount a no disc switch (not shown in FIGS. 1 and 2) to the bottom side of the disc support plate 40. Located to the right of the curved slot 46 are two countersunk apertures 78. The countersunk apertures 78 will be used to mount a start switch (not shown in FIGS. 1 and 2) to the bottom side of the disc support plate 40.

Figure 5:
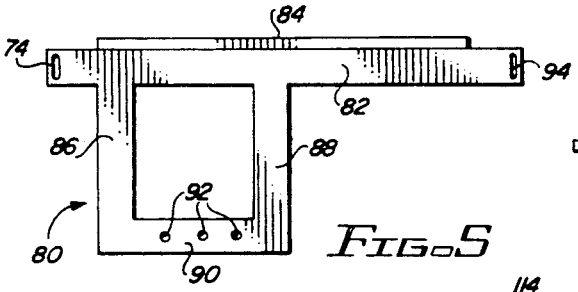
FIG. 5 is a side plan view of a first frame member for installation under the disc support plate illustrated in FIGS. 1 through 4.
Figure 6:
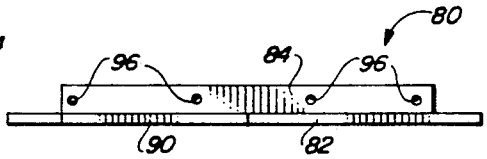
FIG. 6 is a bottom plan view of the first frame member illustrated in FIG. 5.

Referring now to FIGS. 5 and 6, a first frame member 80 is illustrated. The first frame member 80 has a first segment 82 extending the length of the first frame member 80. An angle segment 84 extends at a ninety degree angle from the top edge of the first segment 82 for the length of the first segment 82 except for short segments at the ends of the first segment 82. The angle segment 84 will be mounted under the bottom side of the disc support plate 40 (FIGS. 1 and 2).

Extending downward from the bottom edge of the first segment 82 near one end thereof is a first leg 86. Extending downward from the bottom edge of the first segment 82 near the midpoint thereof is a second leg 88. Extending between the bottom ends of the first and second legs 86 and 88 is a second segment 90. The second segment 90 has a plurality of apertures 92 located therein, one of which apertures 92 will be used to mount one end of a pivot rod (not shown in FIGS. 5 and 6) therein.

The ends of the first segment 82 each have a slot 94 located therein. The slots 94 may be used to attach handles used to support and carry the disc launching apparatus. The angle segment 84 has a plurality of apertures 96 located therein. The apertures 96 will be used for screws used to attach the first frame member 80 to the bottom side of the disc support plate 40 (FIGS. 1 and 2).

Figure 8:
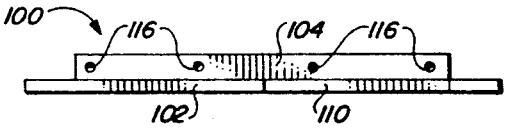
FIG. 8 is a bottom plan view of the second frame member illustrated in FIG. 7.
Figure 7:
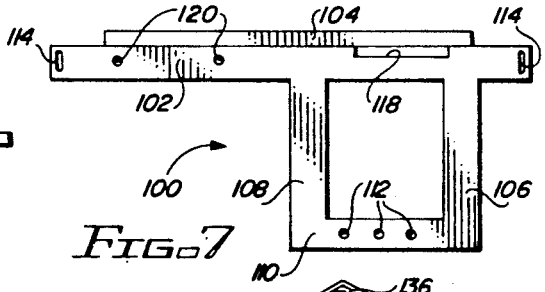
FIG. 7 is a side plan view of a second frame member for installation under the disc support plate illustrated in FIGS. 1 through 4.

Referring now to FIGS. 7 and 8, a second frame member 100 is illustrated. The second frame member 100 has a first segment 102 extending the length of the second frame member 100. An angle segment 104 extends at a ninety degree angle from the top edge of the first segment 102 for the length of the first segment 102 except for short segments at the ends of the first segment 102. The angle segment 104 will also be mounted under the bottom side of the disc support plate 40 (FIGS. 1 and 2).

Extending downward from the bottom edge of the first segment 102 near one end thereof is a first leg 106. Extending downward from the bottom edge of the first segment 102 near the midpoint thereof is a second leg 108. Extending between the bottom ends of the first and second legs 106 and 108 is a second segment 110. The second segment 110 has a plurality of apertures 112 located therein, one of which apertures 112 will be used to mount one end of a pivot rod (not shown in FIGS. 7 and 8) therein.

The ends of the first segment 102 each have a slot 114 located therein. The slots 114 may also be used to attach handles used to support and carry the disc launching apparatus. The angle segment 104 has a plurality of apertures 116 located therein. The apertures 116 will also be used for screws used to attach the second frame member 100 to the bottom side of the disc support plate 40 (FIGS. 1 and 2).

As described to this point, the second frame member 100 is a mirror image to the first frame member 80 (FIGS. 5 and 6). The second frame member 100 has two additional features which are not included in the first frame member 80. First, a slot 118 is located in the first segment 102 between the first leg 106 and the second leg 108. The slot 118 will be used to allow an idler arm (not shown in FIGS. 7 and 8) to pass therethrough. Secondly, a pair of apertures 120 are located in the first segment 102 near the end opposite the slot 118. The apertures 120 will be used for screws used to mount a circuit board (not shown in FIGS. 7 and 8) to the first segment 102.

Figure 9:
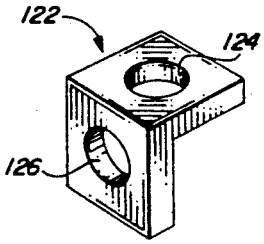
FIG. 9 is an isometric view of an L-shaped bracket.

Referring now to FIG. 9 an L-shaped bracket 122 is illustrated. The top arm of the L-shaped bracket 122 has an aperture 124 extending therethrough. Likewise, the side arm of the L-shaped bracket 122 has an aperture 126 extending therethrough.

Figure 10:
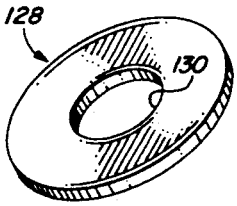
FIG. 10 is an isometric view of a support washer which will be used to orient an ejection rod with respect to the disc support plate illustrated in FIGS. 1 through 4.

Referring next to FIG. 10 a support washer 128 is illustrated. The support washer 128 has an aperture 130 therethrough of a size to admit the ejection rod (not shown in FIGS. 1 through 4) freely therethrough. The support washer 128 will be located below the disc support plate 40 (FIGS. 1 and 2), and will close the portion of the circular aperture 42 (FIGS. 1 and 2) not occupied by the ejection rod.

Figure 11:
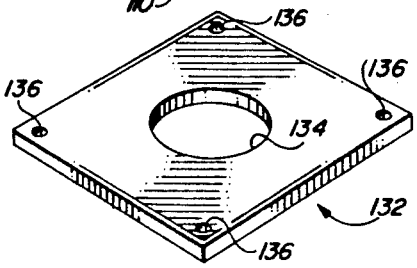
FIG. 11 is an isometric view of a square support plate which will be mounted under the disc support plate illustrated in FIGS. 1 through 4, and which will lock the support washer illustrated in FIG. 10 between the disc support plate and the square support plate.

Referring next to FIG. 11, a square support plate 132 is illustrated. The square support plate 132 has a centrally located aperture 134 extending therethrough, which aperture 134 is of the same size as the circular aperture 42 in the disc support plate 40 (FIGS. 1 and 2). Located at the four corners of the square support plate 132 are four apertures 136 The apertures 136 will be used for screws used to mount the square support plate 132 below the bottom side of the disc support plate 40 (FIGS. 1 and 2).

Figure 12:
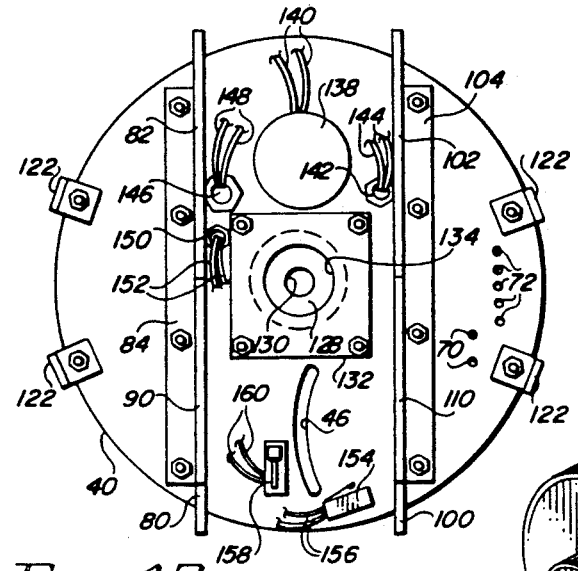
FIG. 12 is a bottom plan view of the disc support plate illustrated in FIGS. 1 through 4 with the first frame member illustrated in FIGS. 5 and 6, the second frame member illustrated in FIGS. 7 and 8, four of the L-shaped brackets illustrated in FIG. 9, the support washer illustrated in FIG. 10, and the square support plate illustrated in FIG. 11 mounted under the disc support plate, and also showing a number of switches and a lamp assembly mounted onto the disc support plate.

Referring now to FIG. 12, the assembly of the various components described in FIGS. 1 through 11, plus other standard components, is illustrated. In this assembly procedure, a number of identical flat head machine screws and nuts will be used. For the sake of simplicity, particularly in the drawings, the machine screws and nuts will not be assigned reference numerals. It will be understood that they are standard hardware items, familiar to those skilled in the art. Note that the front and rear edges of the disc support plate 40 in FIG. 12 have the same orientation as they did in FIG. 2.

The first frame member 80 (shown in detail in FIGS. 5 and 6) is located below the bottom of the disc support plate 40 as shown, with the end of the first frame member 80 having the second segment 90 suspended below the first segment 82 being located at the front edge of the disc support plate 40. The first frame member 80 is attached to the bottom of the disc support plate 40 with four machine screws and nuts, the machine screws each extending through one of the countersunk apertures 66 in the disc support plate 40 and a corresponding one of the apertures 96 in the first frame member 80.

The second frame member 100 (shown in detail in FIGS. 7 and 8) is located below the bottom of the disc support plate 40 as shown, with the end of the second frame member 100 having the second segment 110 suspended below the first segment 102 being located at the front edge of the disc support plate 40. The second frame member 100 is attached to the bottom of the disc support plate 40 with four machine screws and nuts, the machine screws each extending through one of the countersunk apertures 68 in the disc support plate 40 and a corresponding one of the apertures 116 in the second frame member 100.

Four of the L-shaped brackets 122 (shown in detail in FIG. 9) are attached to the bottom side of the disc support plate 40 with four machine screws and nuts. The machine screws each extend through one of the countersunk apertures 74 in the disc support plate 40 and the aperture 124 in one of the L-shaped brackets 122. The side leg (containing the aperture 126) of each of the L-shaped brackets 122 is oriented radially outwardly.

The support washer 128 (shown in detail in FIG. 10) is placed under the bottom side of the disc support plate 40 in its desired position. The aperture 130 in the support washer 128 is located as desired, according to the size of the saucer-shaped game disc to be used and the direction in which the saucer-shaped game disc is to be urged (other than upward) by the ejection rod (not shown). The entire aperture 130 of the support washer 128 will be oriented within the circular aperture 42 of the disc support plate 40 (FIGS. 1 and 2).

The square support plate 132 (shown in detail in FIG. 11) is then placed under the support washer 128 on the bottom side of the disc support plate 40. The square support plate 132 is then attached to the bottom side of the disc support plate 40 with four machine screws, springs and nuts. The machine screws each extend through one of the countersunk apertures 64 in the disc support plate 40 and a corresponding one of the apertures 136 in the square support plate 132.

These screws with springs thus are used to press/lock the support washer 128 in place between the bottom side of the disc support plate 40 and the top side of the square support plate 132. Note that the entire aperture 130 of the support washer 128 will also be oriented within the aperture 134 of the square support plate 132 (which is aligned by design with the circular aperture 42 of the disc support plate 40, shown in FIGS. 1 and 2). Note that the outer perimeter of the support washer 128 is shown in dotted lines in FIG. 12.

An electric motor 138 is mounted under the bottom side of the disc support plate 40 with the shaft of the motor (not shown) extending upwardly through the motor shaft aperture 44 (FIGS. 1 and 2) in the disc support plate 40. Four machine screws are used in the countersunk apertures 62 in the disc support plate 40, with the top of the motor 138 having corresponding threaded apertures (not shown) therein. The motor 138, which is in the preferred embodiment a DC motor such as a hobby starter motor, has a pair of wires 140 extending therefrom.

A rotation direction selection switch 142 is mounted in the aperture 60 in the disc support plate 40 so that the rotation direction selection switch 142 is accessible from the top side of the disc support plate 40. The rotation direction selection switch 142 has a pair of wires 144 extending therefrom.

A lamp assembly 146 is mounted in the aperture 56 in the disc support plate 40 so that light from the lamp assembly 146 is directed up from the top side of the disc support plate 40. The lamp assembly 146 has a pair of wires 148 extending therefrom. A light switch 150 is mounted in the aperture 58 in the disc support plate 40 so that the light switch 150 is accessible from the top side of the disc support plate 40. The light switch 150 has a pair of wires 152 extending therefrom.

A no disc switch 154 is mounted under the bottom side of the disc support plate 40 using a pair of machine screws extending through the countersunk apertures 76 (FIGS. 1 and 2). The no disc switch 154 has a pair of wires 156 extending therefrom. A start switch 158 is mounted under the bottom side of the disc support plate 40 using a pair of machine screws extending through the countersunk apertures 78 (FIGS. 1 and 2). The start switch 158 has a pair of wires 160 extending therefrom.

Figure 13:
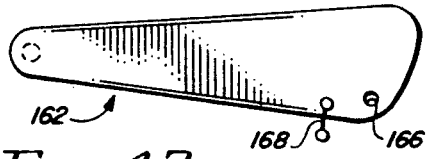
FIG. 13 is a bottom plan view of an idler arm.
Figure 14:
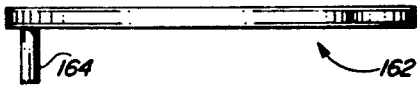
FIG. 14 is a side plan view of the idler arm illustrated in FIG. 13, showing the pin extending from the top of the idler arm.

Moving now to FIGS. 13 and 14, an idler arm 162 is illustrated. The idler arm 162 is flat with a wider end and a narrower end, with a pin 164 extending from the top side of the narrower end of the idler arm 162. The pin 164 will extend from the bottom side of the disc support plate 40 through the curved slot 46 (FIG. 12). Close adjacent the wider end of the idler arm 162, near one side thereof, is an aperture 166 extending through the idler arm 162.

Located on the same side of the idler arm 162 a short distance away from the aperture 166 toward the narrower end of the idler arm 162 is another aperture 168. This aperture 168 is for retaining a screw to hold the second end of a spring (not shown in FIGS. 1 and 2). The corner adjacent the aperture 166 is rounded with a smooth radius. This smooth radius is important to the operation of the idler arm 162.

Figure 15:
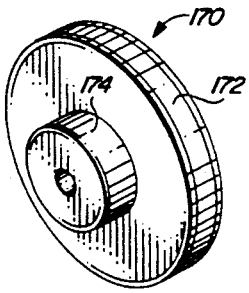
FIG. 15 is an isometric bottom view of a drive wheel, showing an outer frictional surface thereof.

Referring next to FIG. 15, a drive wheel 170 is illustrated. The outer surface 172 of the drive wheel 170 is in the preferred embodiment made of a material having a high frictional coefficient, such as rubber. The drive wheel 170 has a hub 174 which will be used to mount the drive wheel 170 on the shaft (not shown) of the motor 138 (FIG. 12).

Figure 16:
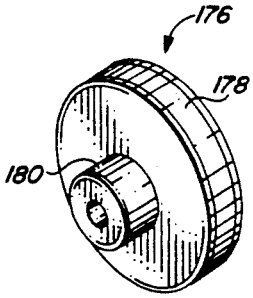
FIG. 16 is an isometric bottom view of an idler wheel, showing an outer frictional surface thereof.

Referring now to FIG. 16, a idler wheel 176 is illustrated. The outer surface 178 of the idler wheel 176 is in the preferred embodiment also made of a material having a high frictional coefficient, such as rubber. The idler wheel 176 has a hub 180 which will be used to mount the idler wheel 176 on the pin 164 of the idler arm 162 (FIGS. 13 and 14).

The hub 180 of the idler wheel 176 is important in its design. The diameter of the hub 180 is sized to fit partially in the upper portion of the curved slot 46 (FIG. 3) without touching the curved slot 46. However, when the hub 180 moves past the portion of the curved slot 46 having the protrusion 48 therein (FIG. 4), the hub 180 will contact the protrusion 48 frictionally to act as a braking action on the idler wheel 176, causing it to stop rotating.

Figure 17:
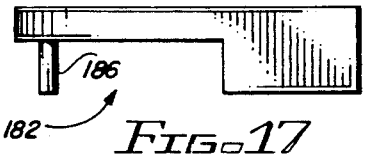
FIG. 17 is a side plan view of a support member used to rotatably support the idler arm illustrated in FIGS. 13 and 14, showing the pin on which the idler arm will be mounted.
Figure 18:
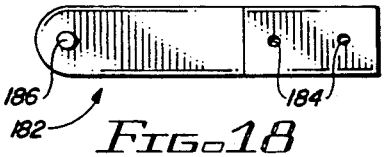
FIG. 18 is a top plan view of the support member illustrated in FIG. 17, showing apertures which will be used to mount the support member.

Referring next to FIGS. 17 and 18, a support member 182 which will support the idler arm 162 (FIGS. 13 and 14) is illustrated. The support member 182 has one of two thicknesses throughout its length. At one end, it is thick, with a pair of threaded apertures 184 located in the top side at this thicker end. The top side of this thicker end of the support member 182 will be mounted on the bottom side of the disc support plate 40 below the countersunk apertures 70 in the disc support plate 40 (FIG. 12).

The thinner end of the support member 182 will be spaced away from the bottom side of the disc support plate 40 (FIG. 12) when the support member 182 is installed. Extending upwardly from the top side of the support member 182 is a pin 186 which will be used to support the idler arm 162 (FIGS. 13 and 14). The idler arm 162 will have a degree of rotation about the pin 186 of the support member 182.

Referring now to FIG. 19, the disc ejection mechanism is illustrated as it will be installed on the assembly of FIG. 12. To simplify the depiction of FIG. 19, only a portion of the assembly of FIG. 12 is illustrated. A link member 188 having a plurality of apertures 190 located in intermediate locations along the length of the link member 188 is shown pivotally mounted on a pivot rod 192. One end of the pivot rod 192 is shown to be installed in one of the apertures 92 in the second segment 90 of the first frame member 80. The other end of the pivot rod 192 would be installed in one of the apertures 112 in the second segment 110 of the second frame member 100 (not shown).

Figure 21:
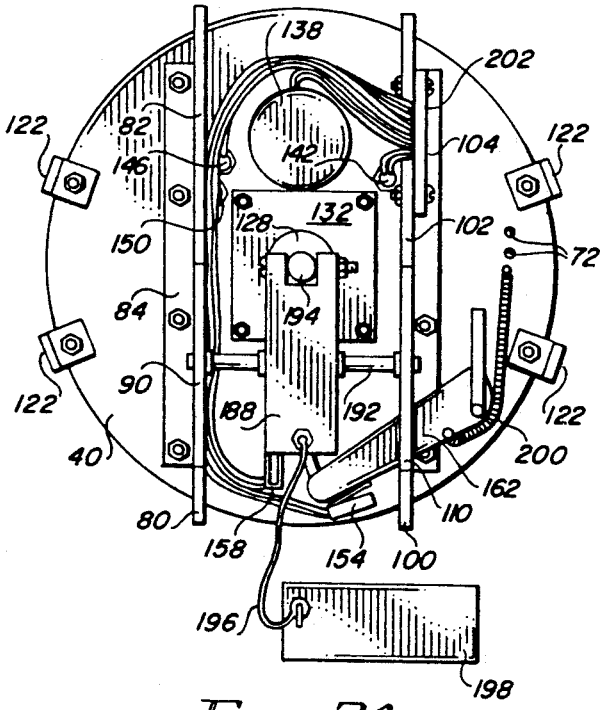
FIG. 21 is a bottom plan view of the disc support plate as illustrated in FIG. 20.

One end of the link member 188 (which is shown in FIG. 21 to have a slot therein) is pivotally mounted to the bottom end of an ejection rod (which fits into the slot, as shown in FIG. 21) using a bolt and a nut. The other end of the ejection rod 194 extends upwardly through the aperture 134 in the square support plate 132, the aperture 130 in the support washer 128, and the circular aperture 42 in the disc support plate 40. The other end of the link member 188 is just barely in contact with the start switch 158 (but not enough to actuate the start switch 158).

The end of the link member 188 not connected to the ejection rod 194 is also connected to one end of a cable member 196, the other end of which cable member 196 is attached to one end of a foot pedal 198. The one end of the foot pedal 198 is supported by the cable member 196 above the ground as shown. The other end of the foot pedal 198 is located on the ground. The positions of the various components as shown in FIG. 19 are their ready positions.

In these ready positions, the center of a saucer-shaped game disc mounted on the disc support plate 40 would be located just above the top end of the ejection rod 194. Thus, by depressing the center of the saucer-shaped game disc, the ejection rod 194 would move downwardly slightly, causing the end of the link member 188 adjacent the start switch 158 to actuate the start switch 158. It will be appreciated by those skilled in the art that by stepping on the foot pedal 198, the cable member 196 will cause the link member 188 to raise the ejection rod 194, which will force the saucer-shaped game disc upwardly off of the disc support plate 40.

Figure 20:
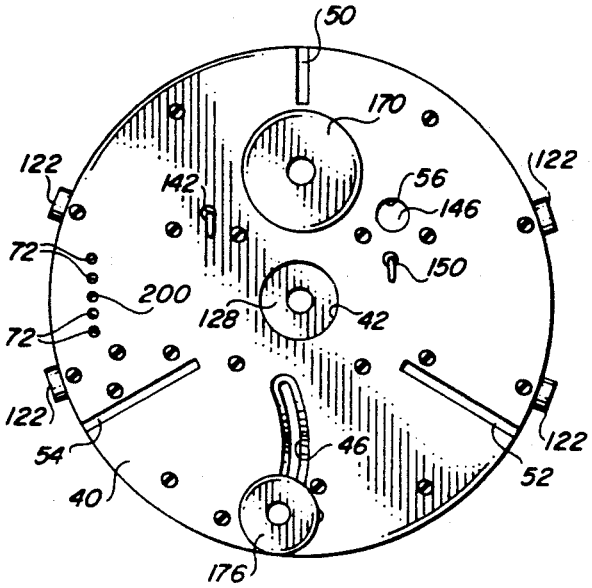
FIG. 20 is a top plan view of the disc support plate as illustrated in FIG. 12, with the idler arm illustrated in FIGS. 13 and 14, the drive wheel illustrated in FIG. 15, the idler wheel illustrated in FIG. 16, the support member illustrated in FIGS. 17 and 18, and the disc ejection mechanism illustrated in FIG. 19 mounted onto the disc support plate.

Referring next to FIGS. 20 and 21, the drive wheel 170 is shown installed on the shaft (not shown) of the motor 138. The idler wheel 176 is shown rotatably installed on the pin 164 (FIG. 14 of the idler arm 162, Which pin 164 extends through the curved slot 46 in the disc support plate 40. The idler arm 162 extends through the slot 118 in the first segment 102 of the second frame member 100 (FIG. 7), and is mounted on the pin 186 of the support member 182 (FIG. 17), which pin 186 extends through the aperture 166 in the idler arm 162 (FIG. 13). The support member 182 is mounted under the bottom of the disc support plate 40 using a pair of machine screws extending through the countersunk apertures 70 (FIG. 12) and into the threaded apertures 184 of the support member 182 (FIG. 18).

The drive wheel 170 and the idler wheel 176 in the preferred embodiment are installed so that they are angled slightly downwardly where they will contact the inner rim of a saucer-shaped game disc.

A spring 200 has one end fastened to the screw-in aperture 168 in the idler arm 162 (FIG. 13), and the other end fastened to one of the apertures 72 in the disc support plate 40. The spring 200 extends around the smooth radius of the idler arm 162, and will cause the idler arm 162 to be urged counterclockwise when viewed from the bottom as in FIG. 21. This will normally urge the idler wheel 176 radially outwardly. When a saucer-shaped game disc is not installed, the idler wheel 176 will move radially outwardly as shown in FIG. 20, causing the hub 180 (FIG. 16) of the idler wheel 176 to contact the protrusion 48 in the curved slot 46 of the disc support plate 40 (FIG. 4), producing a braking action on the idler wheel 176 to stop it from rotating.

As suggested by FIG. 19, one end of the pivot rod 192 is installed in one of the apertures 92 in the second segment 90 (FIG. 5) of the first frame member 80, and the other end of the pivot rod 192 is installed in the corresponding one of the apertures 112 in the second segment 110 (FIG. 7) of the second frame member 100. The pivot rod 192 may be retained in place by using C-shaped washers fitting into slots (not shown) in the pivot rod 192, as is standard in the art.

The link member 188 is pivotally mounted on the pivot rod 192 with the pivot rod 192 extending through one of the apertures 190 (FIG. 19) in the link member 188. The link member 188 may also be retained in place on the pivot rod 192 by using C-shaped washers fitting into slots (not shown) in the pivot rod 192.

The disc ejection mechanism may be adjusted in a two step process. The first step is to change which of the apertures 190 in the link member 188 the pivot rod 192 is installed in. The second step is to change which of the apertures 92 in the second segment 90 (FIG. 5) of the first frame member 80, and which corresponding one of the apertures 112 in the second segment 110 (FIG. 7) of the second frame member 100 the ends of the pivot rod 192 are installed in. Both steps must be done to ensure proper operation of the disc ejection mechanism.

A circuit board 202 is mounted onto the second frame member 100 using a pair of machine screws and nuts extending through the apertures 120 in the first segment 102 of the second frame member 100 and apertures (not shown) in the circuit board 202. The circuit board 202 includes the control circuitry which will operate the disc launching apparatus of the present invention. The wires from the various components are all electrically connected to the circuit board 202.

Figure 23:
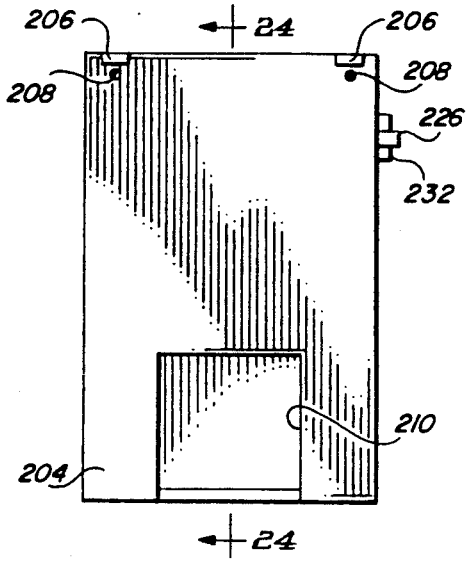
FIG. 23 is a front side view of the housing member illustrated in FIG. 22, showing an aperture located in the front of the housing member at the bottom thereof through which the foot pedal illustrated in FIG. 19 will extend.
Figure 24:
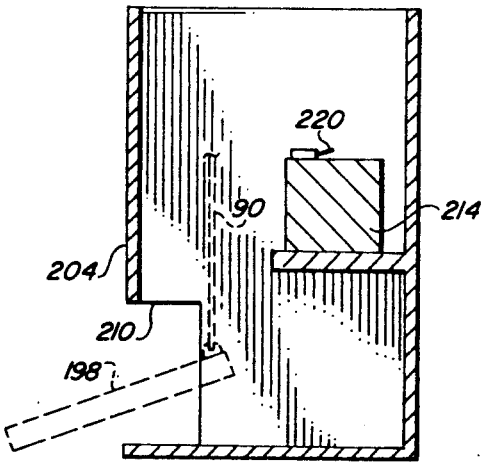
FIG. 24 is a cross-sectional side view of the housing member illustrated in FIGS. 22 and 23, showing how the foot pedal illustrated in FIG. 19 will be located therein.

Referring now to FIGS. 22 through 24, a cylindrical housing member 204 is illustrated which has a diameter approximately equal to the diameter of the disc support plate 40 (FIGS. 20 and 21). The housing member 204 has four notches 206 in the top edge thereof to receive the L-shaped brackets 122 (FIG. 21). Located in the side of the housing member 204 below the notches 206 are apertures 208 for installation of self-threading screws (not shown). Located in the front side of the housing member 204 at the bottom is an opening 210 from which the foot pedal 198 (FIG. 19) will extend.

Located inside the housing member 204 just above the bottom is a shelf 212, which occupies the rear half of the housing member 204. Located on the shelf 212 is a battery 214, which has a pair of terminals 216 and 218. A wire 220 is electrically connected to the terminal 216, and a wire 222 is electrically connected to the terminal 218. The wires 220 and 222 will also be connected to the circuit board 202 (FIG. 21).

Mounted in the side of the housing member 204 are a pair of charging terminals 224 and 226. A wire 228 is electrically connected to the charging terminal 224, and a wire 230 is electrically connected to the charging terminal 226. A battery gauge 232 is also mounted in the side of the housing member 204, and has a pair of wires 234 extending therefrom. The wires 228, 230, and 234 will also be connected to the circuit board 202 (FIG. 21).

Figure 25:
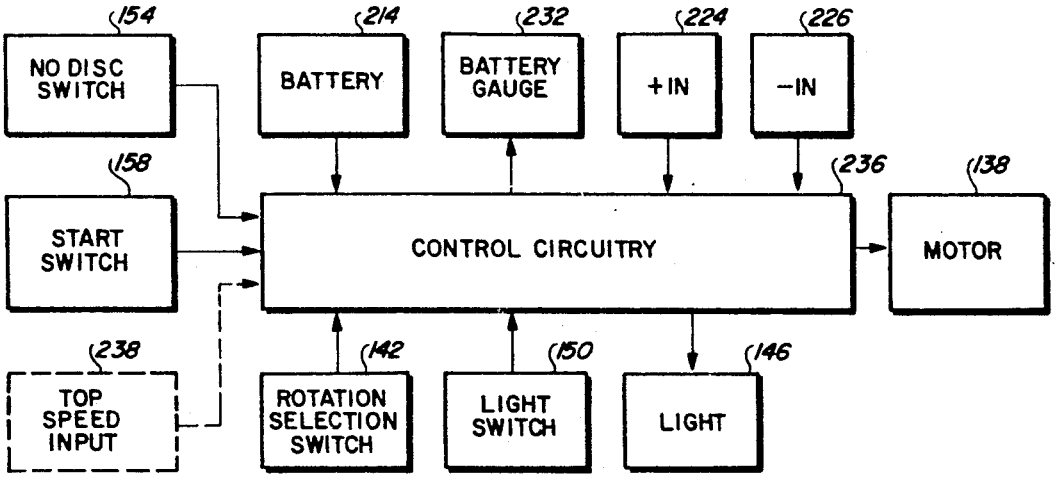
FIG. 25 is a schematic plan view of the electrical system of the disc launching apparatus of the present invention.

Referring now to FIG. 25, a schematic block diagram is provided which illustrates the electrical operation of the disc launching apparatus. The block implementing the functions of the circuit board 202 (FIG. 21) is the control circuitry 236. The battery 214 provides power, the battery gauge 232 provides an indication of how much power is left in the battery 214, and the charging terminals 224 and 226 provide inputs through which the battery 214 may be recharged. The motor 138 is operated by the control circuitry 236.

The no disc switch 154 provides an indication of whether or not a saucer-shaped game disc is properly placed on the disc launching apparatus. If no disc is present, the spring 200 will bias the idler arm 162 to move the idler wheel 176 radially outwardly, actuating the no disc switch 154. The start switch 158 will initiate operation of the disc launching apparatus when the center of the saucer-shaped game disc on the apparatus is pushed, causing the ejection rod 194 to move downwardly to move the link member 188 to actuate the start switch 158.

The rotation direction selection switch 142 determines which direction the saucer-shaped game disc will be rotated by the disc launching apparatus (which can be particularly useful to left handed people). The light switch 150 causes the lamp assembly 146 to be illuminated (enabled) during spin up, which feature is used to "charge" a light-emitting saucer shaped game disc prior to ejecting it from the disc launching apparatus, thereby causing a light-emitting saucer-shaped game disc to glow at night after its release.

In one additional optional feature, a top speed switch 238 is added. The top speed switch 238 is used to select the top speed at which a saucer-shaped game disc will be rotated to by the disc launching apparatus. The top speed switch 238 may either be a fully variable switch to select any speed up to the maximum speed, or it may be a multiple speed switch used to select one of two or three speeds, for example. This feature is particularly useful if the disc launching apparatus will be used both by children and by adults. It should also be noted that the control circuit has an automatic safety shut off feature so that if a spinning disc is not ejected from the disc launching apparatus within a certain period of time, the disc launching apparatus will shut off, thus never allowing the motor or control circuitry to overheat.

Referring finally to FIG. 26, the disc launching apparatus is illustrated fully assembled. To operate it, first the rotation direction selection switch 142 is set to select which direction of rotation will be used. Then, if a light-emitting saucer-shaped game disc is to be used, the light switch 150 is used to enable the lamp assembly 146. Otherwise, the light switch 150 is left turned off. If the disc launching apparatus includes a top speed switch 238, the top speed of the saucer-shaped game disc is selected.

Next, a saucer-shaped game disc is placed on the disc launching apparatus. One side of the inside rim of the saucer-shaped game disc is placed over the idler wheel 176, and the idler wheel 176 is pulled inwardly toward the center on the disc support plate 40. The saucer-shaped game disc is placed over the drive wheel 170 so that the other side of the inside rim of the saucer-shaped game disc fits over the drive wheel 170. The idler wheel 176 will then move radially outwardly somewhat to take up the slack so that the inside rim is seated on both the drive wheel 170 and the idler wheel 176. With a saucer-shaped game disc installed, the no disc switch 154 will not be actuated.

To start the disc launching apparatus, the user presses the center of the saucer-shaped game disc downwardly, actuating the start switch 158. The control circuitry 236 will start the motor 138 to begin rotating the saucer-shaped game disc. The speed will start out slowly in the preferred embodiment, and will gradually accelerate to the maximum speed.

When the saucer-shaped game disc is rotating at the maximum speed, the foot pedal 198 is depressed, causing the ejection rod 194 to force the saucer-shaped game disc upwardly. The upward movement of the saucer-shaped game disc is controlled by the amount of force applied to the foot pedal 198. When the saucer-shaped game disc leaves the disc launching apparatus, the idler wheel 176 will be moved radially outwardly by the force of the spring 200 (FIG. 21), bringing the hub 180 of the idler wheel 176 into contact with the protrusion 48 in the curved slot 46 of the disc support plate 40 (FIG. 4), causing the idler wheel 176 to stop spinning. As the idler wheel 176 moves radially outwardly, the no disc switch 154 will be actuated, turning off the motor 138.

It may therefore be appreciated from the above detailed description of the preferred embodiment of the present invention that it teaches a disc launching apparatus for spinning and launching saucer-shaped game discs. The disc launching apparatus of the present invention is capable of releasing a saucer-shaped disc locally to the disc launching apparatus after spinning it at high speed, instead of throwing the saucer-shaped game disc away from the disc launching apparatus. The disc launching apparatus of the present invention also provides sufficient directional control during the ejection of the saucer-shaped game disc to cause the saucer-shaped game disc to be repeatedly provided to the user at essentially the same location relative to the disc launching apparatus.

The disc launching apparatus of the present invention is both compact and portable, thereby allowing it to be easily carried to any desired location. The disc launching apparatus is also both easy and safe to use. The disc launching apparatus is automatically adjustable to fit various size saucer-shaped game discs (accommodating all full size discs). In a further aspect of the present invention, the disc launching apparatus provides the ability to "charge" light-emitting saucer-shaped game discs prior to ejecting them from the disc launching apparatus, thereby causing the light-emitting saucer-shaped game discs to glow at night after their release.

The disc launching apparatus of the present invention is of durable and long lasting construction, and requires little or no maintenance to be provided by the user. The disc launching apparatus of the present invention is inexpensive both to manufacture and to use, thereby afording it the broadest possible market appeal. Finally, all of the aforesaid advantages and objectives of the disc launching apparatus of the present invention are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A disc launching apparatus, comprising:

a support member having a top surface defining a first side and a second side opposite said first side;

a first wheel mounted for rotation about a fixed axis extending from said top surface of said support member on said first side thereof;

means for driving said first wheel to rotate;

a second wheel mounted for rotation about a moveable axis extending from said top surface of said support member on said second side thereof, said second wheel being moveable between a first position relatively far away from said first wheel and a second position relatively closer to said first wheel to adapt to the size of a disc fitting over both of said first and second wheels;

means for biasing said second wheel said second position toward said first position; and means for urging a rotating disc located on said first and second wheels upwardly off of said disc launching apparatus.

2. A disc launching apparatus as defined in claim 1, wherein said support member comprises:

means for rotatably supporting the bottom of a disc.

3. A disc launching apparatus as defined in claim 2, wherein said supporting means comprises:

a plurality of bearing members extending above said top surface of said support member, said bearing members being radially oriented with their ends close adjacent the outer edges of said support member, said bearing members also being spaced at approximately even angular distances.

4. A disc launching apparatus as defined in claim 3, wherein said bearing members comprise three support bars extending above said top surface of said support member.

5. A disc launching apparatus as defined in claim 1, wherein said driving means comprises:

an electric motor mechanically coupled to drive said first wheel.

6. A disc launching apparatus as defined in claim 5, wherein said driving means additionally comprises:

control means for operating said electric motor, said control means causing said motor to start at a relatively slow speed and to gradually accelerate up to a maximum speed.

7. A disc launching apparatus as defined in claim 5, additionally comprising:

means for selecting a maximum speed for said electric motor.

8. A disc launching apparatus as defined in claim 5, additionally comprising:

means for selecting the direction of rotation of said electric motor.

9. A disc launching apparatus as defined in claim 5, additionally comprising:

means for preventing the operation of said electric motor if said second wheel is in said first position indicating that a disc is not installed on said first and second wheels.

10. A disc launching apparatus as defined in claim 5, additionally comprising:

means for stopping the operation of said electrical motor if the disc is not ejected within a certain amount of time, thus never allowing the motor or control circuitry to overheat.

11. A disc launching apparatus as defined in claim 1, wherein said first and second wheels each have frictional outer wheel surfaces.

12. A disc launching apparatus as defined in claim 1, wherein said first and second wheels are installed so that they are angled slightly downwardly where they will contact the inner rim of a disc.

13. A disc launching apparatus as defined in claim 1, wherein said biasing means comprises:

a spring.

14. A disc launching apparatus as defined in claim 1, wherein said urging means comprises:

a rod extending through said support member at a location coinciding with the center of a disc located on said first and second wheels, said rod being moveable between a first retracted position just below the underside of the center of a disc located on said first and second wheels and a second extended position in which said rod forces said disc off of said first and second wheels; and a foot pedal for driving said rod from said first retracted position to said second extended position when said foot pedal is depressed.

15. A disc launching apparatus as defined in claim 14, additionally comprising:

means for adjusting said location at which said rod extends through said support member to accommodate discs of various sizes and to provide a directional orientation when the disc is urged upwardly.

16. A disc launching apparatus as defined in claim 14, additionally comprising:

means for actuating said driving means, said actuating means being activated when the center of a disc on said disc launching apparatus is depressed to drive said rod downwardly from said first retracted position of said rod.

17. A disc launching apparatus as defined in claim 1, additionally comprising:

means for inhibiting rotation of said second wheel when said second wheel is in said first position.

18. A disc launching apparatus as defined in claim 1, additionally comprising:

means for "charging" a light-emitting disc located on said disc launching apparatus, thereby causing the light-emitting disc to glow after launching.

19. A disc launching apparatus as defined in claim 18, wherein said "charging" means comprises:

a lamp assembly mounted on said top surface of said support member; and switch means for enabling/disabling said lamp assembly during a disc spin up.

20. A disc launching apparatus, comprising:

a support member having a top surface defining a first side and a second side opposite said first side;

a first wheel mounted for rotation about a fixed axis extending from said top surface of said support member on said first side thereof;

an electric motor mechanically coupled to drive said first wheel to rotate;

control means for operating said electric motor;

a second wheel mounted for rotation about a moveable axis extending from said top surface of said support member on said second side thereof, said second wheel being moveable between a first position relatively far away from said first wheel and a second position relatively closer to said first wheel to adapt to the size of a disc fitting over both of said first and second wheels;

spring means for biasing said second direction from said second position toward said first position;

means for inhibiting said control means from operating said electric motor if said second wheel is in said first position indicating that a disc is not installed on said first and second wheels; and rod means for urging a rotating disc located on said first and second wheels upwardly off of said disc launching apparatus.

21. A disc launching apparatus, comprising:

a housing member;

a first wheel mounted for rotation about a fixed axis extending from said housing member;

means for driving said first wheel to rotate;

a second wheel mounted for rotation about a moveable axis extending from said housing member, said second wheel being moveable between a first position relatively far away from said first wheel and a second position relatively closer to said first wheel to adapt to the size of a disc fitting over both of said first and second wheels;

means for biasing said second wheel in a direction from said second position toward said first position; and means for urging a rotating disc located on said first and second wheels upwardly off of said disc launching apparatus.

22. A method of launching a saucer-shaped game disc, comprising:

placing one side of the saucer-shaped game disc over a first wheel mounted for rotation about a moveable axis extending from a top surface of a support member on a first side thereof, a second wheel being mounted for rotation about a fixed axis extending from said top surface of said support member on a second side thereof opposite said first side;

moving said first wheel from a first position relatively farther away from said second wheel toward a second position relatively closer to said second wheel;

placing the other side of the saucer-shaped game disc over said second wheel;

biasing said first wheel in a direction from said second position toward said first position to cause said first wheel to adapt to the size of the disc fitting over both of said first and second wheels;

driving said first wheel to rotate to rotate the disc; and urging the rotating disc located on said first and second wheels upwardly off of said disc launching apparatus.

* * * * *